United States Patent [19]

Gardner

[11] Patent Number: 4,538,353

[45] Date of Patent: Sep. 3, 1985

[54] ELECTRONIC FOOT MEASURING APPARATUS AND METHOD

[75] Inventor: F. Philip Gardner, McHenry, Ill.

[73] Assignee: Interco, Incorporated, St. Louis, Mo.

[21] Appl. No.: 685,137

[22] Filed: Dec. 21, 1984

[51] Int. Cl.[3] ..... A43D 1/00

[52] U.S. Cl. ..... 33/3 C; 33/3 B; 33/515

[58] Field of Search ..... 33/3 B, 3 R, 3 C, 4, 33/3 A, 174 D

[56] References Cited

U.S. PATENT DOCUMENTS

| | | | |
|---|---|---|---|
| 2,975,519 | 3/1961 | Berlin, Jr. et al. | 33/3 B |
| 3,457,647 | 7/1969 | Cohen et al. | 33/3 R |
| 4,294,014 | 10/1981 | Baumann et al. | 33/3 B |

FOREIGN PATENT DOCUMENTS

| | | | |
|---|---|---|---|
| 1028361 | 5/1966 | United Kingdom | 33/3 R |
| 2052747 | 1/1981 | United Kingdom | 33/3 C |

*Primary Examiner*—Willis Little

*Attorney, Agent, or Firm*—Robert A. Brown

[57] ABSTRACT

Apparatus for electronically measuring the size of a foot for determining a properly fitted specific shoe size. A light source is arranged to cause an outline of a foot to be delineated upon a translucent panel. Light energy is directed from the panel through photo optic means to an electronic device containing means for inherently discriminating impulses of energy into a distinct white/-black status to produce an electronic duplicate of the foot outline. The electronic image of the foot is processed within the apparatus to determine an accurately fitted size of shoe for the measured foot. Video display means is provided so that a customer may view the process of measurement of the shoe size and be informed of the precisely determined size of shoe to fit the customer's measured foot.

14 Claims, 7 Drawing Figures

FIG. 1
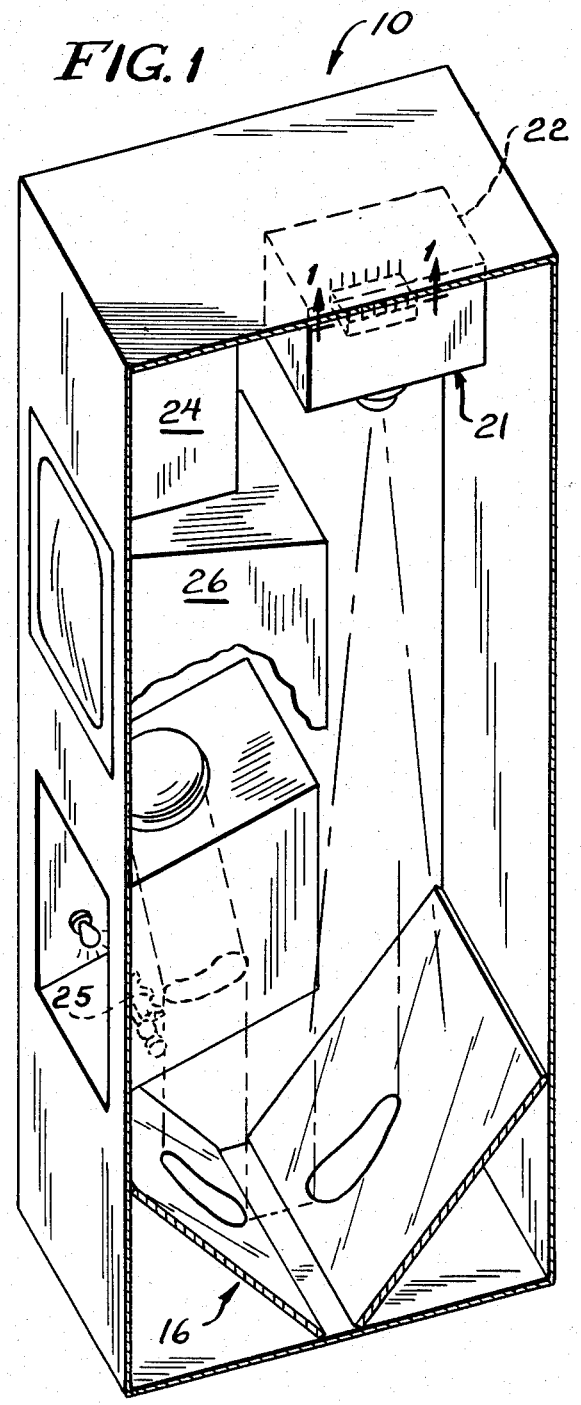
FIG. 2
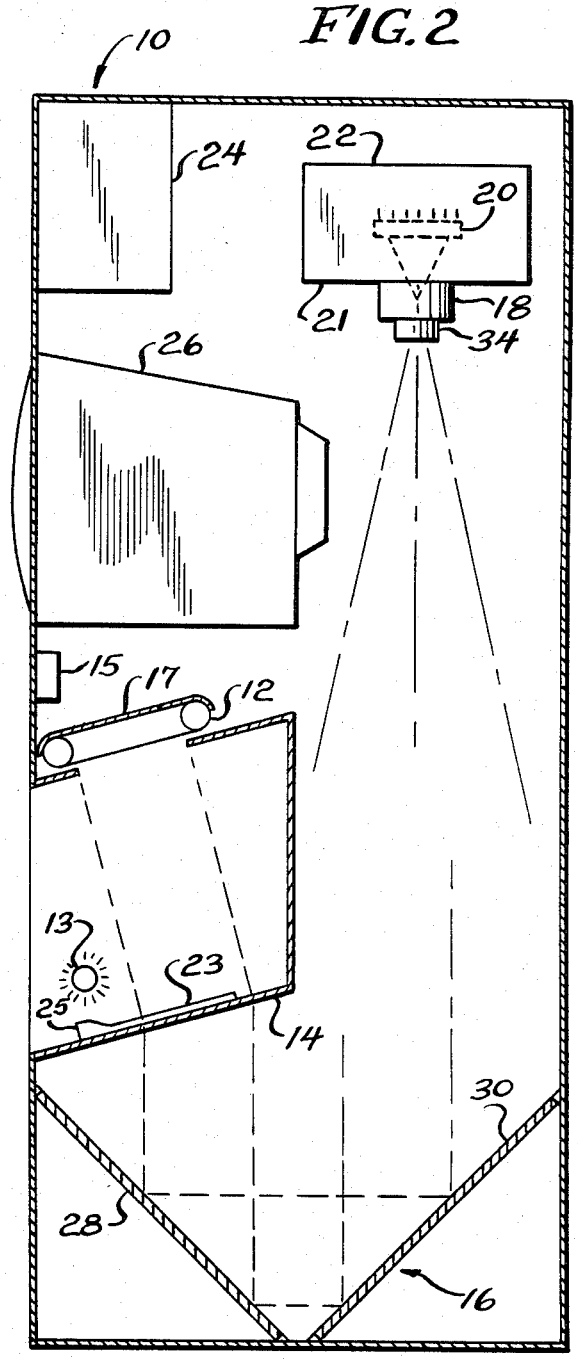
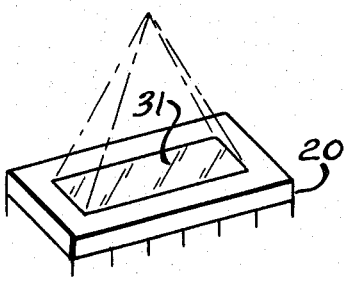
FIG. 1a

ELECTRONIC FOOT MEASURING APPARATUS AND METHOD

BACKGROUND OF THE INVENTION

The present invention relates generally to principles of photogrammetry, electronics and computer technology and more particularly to means for measuring the human foot in order to determine a specific shoe size with a degree of accuracy considerably greater than that achieved by technology of the prior art.

More specifically, this invention relates to an apparatus containing a light source which is arranged to cause an outline of a foot to be displayed upon a translucent screen whereby photo-optic principles are employed to direct an image of the outline to the surface of an electronic device containing a monolithic array of light sensitive semiconductor elements which sense strong or weak impulses of energy and inherently discriminate this information into a distinct white/black, light/dark status or relationship to create an electronic duplicate of the foot outline. The electronic image of the foot can then be processed according to a predetermined algorithm so as to determine the shoe size that would provide the best fit. It will be noted that the number of light sensitive elements available with the advanced technology described herein is well beyond that achieved by the prior art. The resolution of status thus obtained accomplishes a precision of measurement never before made possible.

In the past, a number of patents have been issued relating to apparatus for determining sizes of shoes. For example, U.S. Pat. No. 2,975,519 to Berlin confronts the problems of selling shoes by catalog or retail outlet and describes an apparatus wherein a light source is directed toward an opaque plane containing a series of holes strategically placed so as to correspond to the longest and widest portions of an average foot of various sizes. It should be noted that an improper size would be indicated if the longest or widest portion of a given foot does not conform to this average. Thus, a foot of average proportions, even though properly placed in the apparatus, could prevent the light rays from reaching some of the photo-voltaic cells under each of the holes. An arrangement of stepper relays, linkages and print wheels is then used to print the shoe length and width, as determined by the light and dark photo cells, on an order blank. The customer then completes the order blank with his name, address, desired shoe style and color. It is noted that this invention projects a light source in a direction vertical to the plane of the bottom of the foot as opposed to parallel to that plane.

Cohen and Blivice, in U.S. Pat. No. 3,457,647 point out difficulties encountered when using mechanical means that physically touch a foot and compress human tissue. The problem is exacerbated because of further difficulty in determining the exact moment when physical contact has been made between the mechanical means and the foot.

In U.S. Pat. No. 3,328,882, a reference closely related to Cohen, et al '647, a number of light sources and corresponding photo cells are placed in a plane parallel to the bottom surface of the foot and arranged in a matrix such that one set of lights and photo cells is along the length axis of the foot and another set is along the width axis. A properly placed foot would then block some of the cells in each axis and this information is then used to determine the proper length and width shoe.

Cohen et al '647 then state that the large number of photo cells are prohibitive from a cost standpoint and describe an alternate apparatus where only one photo cell (or light source, depending on relative cost) is used per axis and it is moved by motor means along its respective axis until the light path is no longer blocked by the foot and the motor and photo cell is stopped at this position. The position of both motors is tracked by a moving brush contact on a series of contact segments on a printed circuit board surface. The contact closures thus obtained are then encoded by use of a diode matrix and discrete electronic components to display a shoe size and width by illuminating a corresponding set of lights on the apparatus panel. A special-lamp indicates sizes greater than 15 in length or width of EEE.

Greensides U.S. Pat. No. 3,931,681 uses virtually all mechanical means to determine length, width and girth at a point 72.5% of the length as indicated by motorized pointers on a tape measure type scale. This arrangement suffers from the previously mentioned problems of determining an exact point of physical contact on a foot and requires a large number of moving parts.

Baumann, U.S. Pat. No. 4,294,014 states that all of the previous art suffers from the shortcomings of numerous moving parts (stepper relays, printers, brush contacts, motors, etc.) all of which are subject to wear, faulty operation and ultimate failure. Baumann, '014 pinpoints the major source of measurement error shown in prior art as interference caused by light sources adjacent to the light source corresponding to a particular photo cell and the errors caused by effects of incident light and diffraction.

Baumann '014 suggests other forms of radiant energy may be used, such as electromagnetic or sound, and describes a preferred embodiment consisting of infra-red emitters and opposing infra-red sensors arranged in a matrix corresponding to the length and width of the foot and in a plane parallel to the bottom of the foot. This is similar to Ser. No. 346,601 mentioned by Cohen and Blivice, now U.S. Pat. No. 3,328,882, but is now more practical because present day technology has made infra-red devices available at a cost which makes this configuration attractive. This concept would be prone to the error sources described by Baumann except for the sophisticated time division multi-plex and modulation techniques employed whereby only one light source is activated at any one time and the light source is modulated in such a way that only receivers modulated in the same manner will respond to the light source. These techniques are now common and practical in optical emitting and sensing applications. It should be noted the Baumann apparatus measures a shoe size based only upon the maximum length and width measured, with no determination made as to where exactly the maximum occurs.

It is further noted that none of the prior art is suitable for using computer interface technology to measure the size of a foot and also to maintain inventory, predict market trends, automate ordering, or in general acquire data for statistical purposes to advance the art of shoe making.

SUMMARY OF THE INVENTION

Accordingly, it is a primary object of the present invention to provide means for measuring the form of a human foot and process data so obtained into a stored information bank whereby a shoe size is determined that fits properly the human foot being measured.

It is a further object of this invention to provide a foot measuring apparatus which utilizes electronic and computer technology to avoid errors caused by misalignment of mechanical parts that must be moved and positioned about a human foot to obtain a measurement of foot size.

An additional object of this invention is to provide a light source for projecting collimated rays of light for illuminating a human foot and thereby cast a shadow on a translucent panel surface which accurately replicates the outline of the illuminated foot.

Another object of this invention is to provide an association of optical and electronic technologies to convert light energy representing the outline of a human foot into electrical energy that defines with precision the shoe size of the human foot.

It is still a further object of this invention to employ electronic computer and software technology to control operation of the apparatus so as to logically analyze human foot measurement data, compare that data to a plurality of shoe sizes and determine a properly fitted shoe size for a measured human foot.

It is still another object of this invention to provide means submitting computer foot measurement data to an electronic computer whereby an exact foot shape is developed for viewing on the screen of a cathode ray tube.

A further object of this invention is to provide reflective means for receiving rays of light projected from a light source and redirecting the light rays to means for analyzing and resolving the light rays into an accurately formed shape of a human foot.

An apparatus and method in accordance with the present invention comprise an enclosure, a light source for projecting collimated rays of light upon a human foot for delineating a shadow outline thereof, means for transferring the shadow outline to an optical image receiving means, electronic analytical means for receiving and resolving the shadow outline to reflect the exact shoe size of the foot, means for storing information relating to a plurality of shoe sizes, means for comparing the foot shadow outline with the plurality of shoe sizes and determining a shoe size that fits properly the human foot exemplified by the foot shadow outline, and means for informing a patron of a properly fitted shoe size that corresponds to the delineated human foot outline.

DESCRIPTION OF THE DRAWINGS

The foregoing and other characteristics, objects, features and advantages of the present invention will become more apparent upon consideration of the following detailed description having reference to the accompanying figures of the drawings, wherein:

FIG. 1 is an isometric view of an enclosure containing the components of the present invention. A side panel is shown removed to display the interior details.

FIG. 1*a* is an isometric view of a portion of electronic means taken along lines 1—1 of FIG. 1 showing the underside of a light sensitive device containing semiconductor elements and forming a part of the present invention.

FIG. 2 is a side view of the enclosure which will be referenced to describe the physical and optical features and relationships of the main components of the invention.

DESCRIPTION OF THE PREFERRED EMBODIMENT

Figure 3:
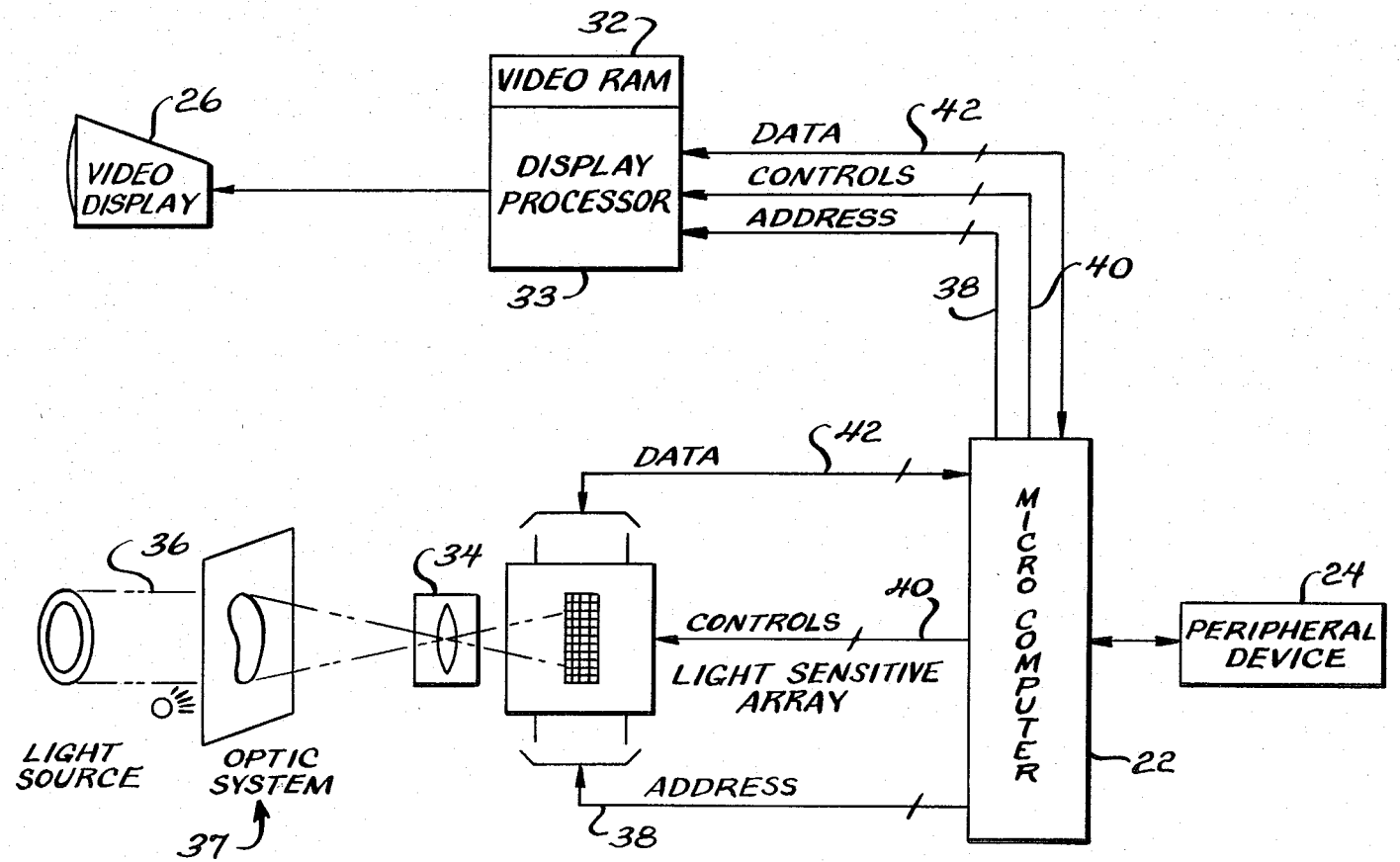
FIG. 3 is a block diagram of the subject invention which depicts each of the essential functions of the invention and shows the interface between the optical and the electronic means of the invention.

An apparatus for measuring the size of a human foot for purposes of determining proper shoe size, generally identified by reference numeral 10 (FIGS. 1 and 2), comprises light source means 12 projecting parallel rays of light, translucent panel means 14 for describing the shadow of a foot placed upon the panel means 14, mirror means generally indicated by reference numeral 16 for redirecting the foot shadow into the field of view of an array scanner, generally identified by reference numeral 21. The array scanner 21 comprises optical means 18 for receiving the redirected foot shadow and focusing the shadow image onto the surfaces of a monolithic integrated circuit 20 comprising photo-sensitive elements which are then interrogated by micro computer means 22 to determine their white/black or light/dark status. The microcomputer means 22 includes software program means for executing a required algorithm. A peripheral I/O (Input/Output) device 24 provides means for communicating with the microcomputer 22, thus controlling execution, parameters, and accepting output information. A cathode ray tube video display 26 provides the means of displaying the processed foot image for viewing.

The peripheral input/output device 24 is depicted as a separate structural function for purposes of explanation and clarity but mainly to emphasize the point that the I/O device 24 may take many forms and not differ from the unique features and concept of this invention. Those skilled in the art will recognize that the I/O device could take the form of a simple "DUMB TERMINAL" as it is referred to in the industry, with pertinent instructions and parameters being entered manually, or it could take the form of a "SMART TERMINAL" or "CO-PROCESSOR" with the instructions and parameters being entered automatically on cue from a customer actuated switch. The CO-PROCESSOR could include storage and calculation facilities to accept output data and process that data to determine "best fit" shoe sizes and even communicate with a "HOST" computer to automatically enter and process the order for a pair or pairs of shoes. Finally, it should be apparent that the I/O device and the microcomputer 22 could be combined as one to perform any and all of the aforementioned functions, all of which are simple to implement with technology known to those skilled in the art.

The light source 12 is shown as a common circular flourescent light with a reflector 17 (FIG. 2); however, any source which produces similar collimated light can be used. The light source 12 is positioned in a plane parallel to the plane of the translucent panel 14 assuring that the collimated light rays are perpendicular thereto and that the resultant shadow on its surface is an accurate reproduction of the shape of a foot placed thereon. At least one, and as shown, two common incandescent light fixtures 13 are provided to ensure that a heel of a foot placed upon panel 14 is properly illuminated. Proper illumination of the heel ensures that a complete foot shadow outline is delineated throughout the periphery of a foot being measured including its heel that may be partially obscured from the light source 12 when a patron places a foot upon the panel 14. Regulating means 15 is suitably connected to the light sources 12 and fixtures 13 to provide a preselected degree and continuity of intensity of light.

The translucent panel 14 is of glass, plastic or other suitable material of sufficient strength and its surface is treated to produce a "ground" or "frosted" surface of optical quality. The panel 14 is fitted with a foot placement fixture 23 and includes a heel stop 25 (FIG. 2) so as to guide the foot to a proper but not critical position.

The mirror means 16 are positioned below the translucent panel 14 and include a first reflective mirror 28 and a second reflective mirror 30 angled precisely so as to cancel the length errors produced by the differences in light path lengths and at the same time redirect the undistorted foot image to a plane parallel to that of the receiving photo-sensitive array 20. Each mirror 28 and 30 has a single reflecting surface so as to eliminate the double image common with mirror systems. It is understood that the mirror means is required only to allow a convenient arrangement of the major components of the invention within the enclosure, and that a different arrangement could be used to eliminate the present use of mirrors and yet not be substantially different from the present invention.

Optical means 18 is a lens system not unlike a camera, of proper construction and focal length, and fitted with alignment, aperture and focal adjustments to project the foot image onto the surface of the photo-sensitive integrated circuit array 20 in the same manner as a photo-sensitive film surface of a common camera receives a photo image.

The photo-sensitive array 20 (FIGS. 1 and 2) makes use of the normal photo-sensitive characteristics of dynamic RAM memory technology, a transparent glass lid 31 (FIG. 1a) (as opposed to a standard opaque lid) and certain other enhancements made to optimize its performance in this application. The device is a $128 \times 256$ element array providing 32,768 photo-sensitive elements and each element is individually addressable using address schemes common to memory technology.

As each photo-sensitive cell is addressed, the white/-black or light/dark status of that particular cell is available at the output terminal of the light sensitive array 20. Thus, by sequencing the address leads of the device, all 32,768 cells can be scanned and the light/dark status of each respective cell is indicated by a stream of serial data from the output terminal of array 20, thereby creating an electronic image which can be analyzed and processed by the microcomputer 22 as directed by an algorithm implemented in software within the microcomputer 22.

It will be obvious to those skilled in the art, that the photo-sensitive array 20 described in the preferred embodiment is representative of but one of a class of these devices and that the invention described herein is not limited to the use of that device and the use of any other similar device is only a matter of implementation details.

The cathode ray tude video display 26 (FIGS. 1 and 2) is a standard type monitor and has no limitations with respect to resolution because it is used only as a visual display for the customer and does not affect accuracy of measurements. Input signals containing the foot image are required to be in the composite video form only because of the implementation of the preferred embodiment, but other signal forms such as a standard RGB (red-green-blue) could be implemented and not deviate from the unique concept of the invention. The use of a color display and color compatible signals allows adjustment of the image and background colors for maximum effectiveness and sales impact.

The block diagram of FIG. 3 generally presents the main elements of the invention and indicates the flow of information and control signals among them and also depicts the transformation of light rays containing intelligence representing the shape of a foot, into electrical signals which can be analyzed and manipulated so as to extract that intelligence and convert it to a form relevant to the primary object of this invention; i.e., determining foot size.

As further described, the invention (FIG. 3) comprises the source 12 of collimated light rays 36; a generally referenced optic system 37, including the translucent panel 14, mirrors 28 and 30, and a lens assembly 34; the array scanner 21; including the optical means 18, the light sensitive array 20, and the microcomputer 22; the peripheral I/O device 24 for input parameters and output data; a video ram 32 and a display processor 33 to store the image to be displayed and to output that image in a composite video format compatible with contemporary television type monitors, and finally the video display device 26 to convert the composite video signals representing the image to a visible image suitable for customer viewing.

It is noted that the preferred embodiment describes a television type monitor as the video display only because that type is generally available and commonly used, but it is not intended to preclude other present or future types of video display such as liquid crystal (LCD), vacuum flourescent (VF), or the like, which could be adapted for this purpose by those with a knowledge of that technology.

Describing now the flow of information beginning at the light source 12, the plurality of parallel light rays 36 are directed toward the translucent panel 14, which they cause to be fully illuminated except for those areas where the rays are blocked by a foot placed upon the foot placement panel 23, in which case an exact shadow of the foot appears on the panel 14 which is also visible on the bottom surface of the panel 14 and is in the field of view of the lens assembly 34 which then focuses the image through the optical means 18 onto the surface of the light sensitive array 20.

The light sensitive array 20 divides the field of view into 32,768 discrete images, referred to as pixels, which provides a resolution of approximately twice that which is deemed sufficient for accurate foot measurements by those knowledgeable in that field. Devices of greater resolution would have no additional value but of course could be used if economy or practicality made their use desirable.

Each discrete pixel is interrogated to determine its light or dark status by setting an address bus 38 to a combination of logical "ones and zeros" which represents the "address" (or number) of the pixel of interest and then activating signals on a control bus 40 from the microcomputer 22 as required, typically involving a "read" and "output enable" function. The above sequence "reads" the status of a single pixel or "bit" at the single output terminal of the array 20 and it is a function of the array scanner 21 associated with the light sensitive array 20 to save these single bits of status until a number of bits which represents a "word" is accumulated and then to output that word of status bits onto a data bus 42 where the word can be acquired by the microcomputer 22 for processing.

The above sequence will be fundamental to those trained in computer technology and they will recognize that the number of "bits" in the "word" referenced above is only a matter of a particular computer's architecture and is not germane to the present invention. It will also be apparent that the functions required of the microcomputer 22 are typical of all microcomputers and that the concepts presented herein are not dependent upon any specific type microcomputer.

After the light sensitive array 20 has been scanned and the status of all pixels has been acquired by the microcomputer 22, various algorithms may be applied to the data to enhance the image by smoothing the outline, reducing or eliminating the effects of "noise" or other unwanted optical aberrations. The smoothed outline is then suitably processed, sorted or otherwise converted into data to allow convenient correlation to a properly fitting shoe size by still another algorithm.

The entire sequence of operation and execution of the various algorithms are controlled by software which is resident within the microcomputer 22 and which is called into action automatically, internally by the microcomputer itself or manually by commands from the peripheral I/O device 24.

Images and or data as desired can be output to the I/O device 24 or to the video ram 32 and display processor 33 for storage and conversion to the signal form required by the video display device 26.

The functions of the video ram 32 and display processor 33 are opposite to, but very similar to the functions of the light sensitive array 20 and associated scanning functions accomplished by the microcomputer 22 in that they accept words of video data from the data bus as directed by signals from the control bus and store the video data in the video ram memory 32 where the data are then read or accessed as individual bits by the display processor 33 and are then output to the video display 26 as individual pixels again where they can be viewed.

It is assumed that the function of the video display itself is apparent to one skilled in the art and requires no further explanation.

Figure 4:
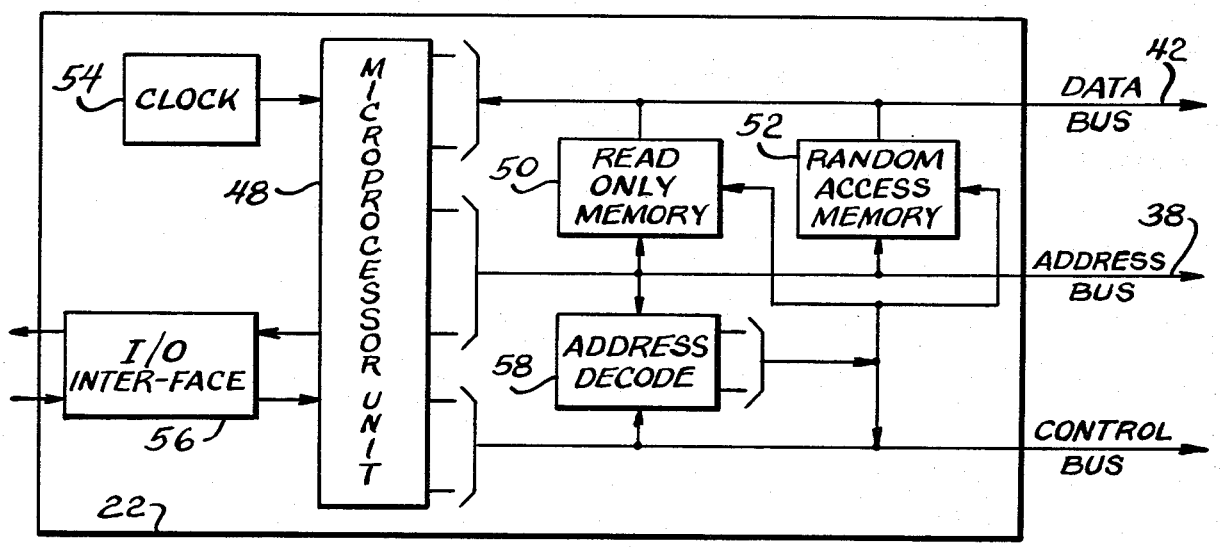
FIG. 4 is a more detailed functional block diagram of the microcomputer of FIG. 3 showing internal components that comprise the "brains" of the present invention.

Turning now to the microcomputer block diagram of FIG. 4, a person skilled in the art will recognize the microcomputer 22 of FIG. 3 comprising the basic functions of a microprocessor unit (MPU) 48, read only memory (ROM) 50, random access memory (RAM) 52, clock 54, I/O interface 56, and address decoder 58 and being connected to the 3 standard buses; the data bus, the address bus, and the control bus. The control bus contains read, write, enable and select signals as needed to inform external devices what function the MPU 48 is presently performing.

The microcomputer 22 internal data bus is a bidirectional path which allows the MPU 48 to acquire or "read" information from the ROM 50 and RAM 52 or any other peripheral device connected to it, or conversely to allow the MPU 48 to output or "write" data to the internal data bus for receipt by the various external devices.

Typically, the MPU outputs simultaneously with data, a logical combination of bits to the internal address bus which indicate to which device the internal data bus information is directed to or requested from.

The address decoder 58 recognizes the various combinations on the internal address bus and provides device or "chip select" signals on the internal control bus which activate the proper device so that it can respond as directed by the MPU 48 internal control bus signals to read or write data on the internal data bus. The address bus information also indicates which memory word or location within the device is to be read from or written to.

The MPU provides read or write signals to the internal control bus which inform the device selected by the "chip select" signals whether to read or write data on the internal data bus.

The clock 54 provides a continuous stream of very accurately timed pulses which the MPU 48 uses to synchronize all of the internal and external events and thus control what happens and when it happens.

The I/O interface 56 may take any one of several forms depending on the details of the final implementation. It may provide a set of bidirectional amplifiers to isolate the MPU 48 from the I/O device 24 or it may change the format of the data from parallel "bytes" to serial bits in accordance with standard practice in the industry (typically RS-232/C). The selection of a particular type MPU chip from the many available types, and the type of I/O device, will ultimately determine the exact form and function of the I/O interface 56.

A skilled engineer will recognize that the functions of the microcomputer 22 of FIG. 4 are typical of today's computer technology and all or a part of these functions may be contained within a single monolithic integrated circuit. It follows that the invention presented herein can take full advantage of present and future microelectronic evolutions to perform the functions required of the basic concept.

It should be noted here that many of the implementation details and algorithms are contained within the software resident in the ROM 50 and that modifications to that software or to the form of storage would have to be significant and substantial before departing from the invention described herein.

Figure 5:
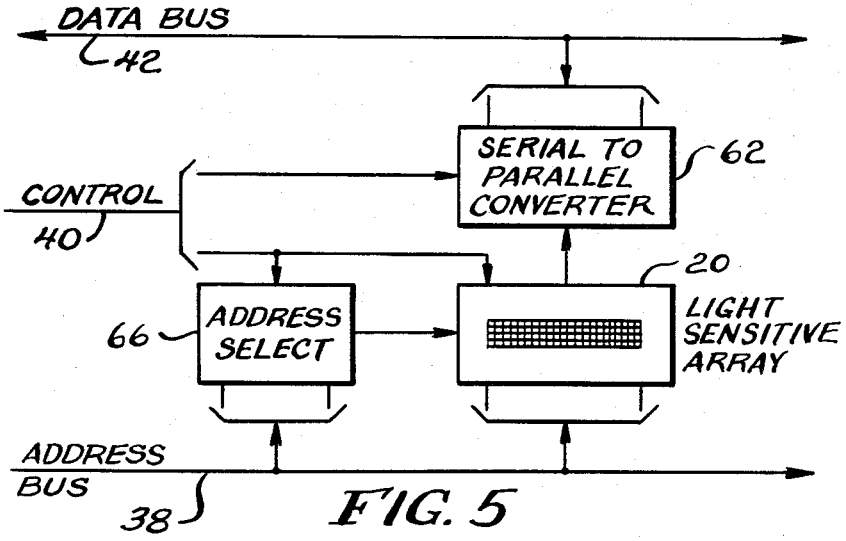
FIG. 5 is a more detailed functional block diagram of the light sensitive array and scanning means. The interconnections to the microcomputer of FIG. 4 are also depicted to show the flow of information and control signals.

An expanded diagram of the light sensitive array and array scanner is presented in FIG. 5 wherein a serial to parallel converter 62, the light sensitive array 20 and address select logic 66 are depicted.

The address select logic 66 combines the address bus 38 signals with control bus 40 signals to generate signals which cause the light sensitive array 20 to output a signal which indicates the light or dark status of a single light sensitive cell or pixel.

The serial to parallel converter 62 performs the function of committing a small number of bits to memory which saves the status of each pixel as it is read from the light sensitive array 20 until a number of them which constitutes a "word" has been accumulated and at which time the contents of the converter 62 are read by the MPU 48 (FIG. 4) and the process is repeated, thus effecting serial to parallel conversion.

Figure 6:
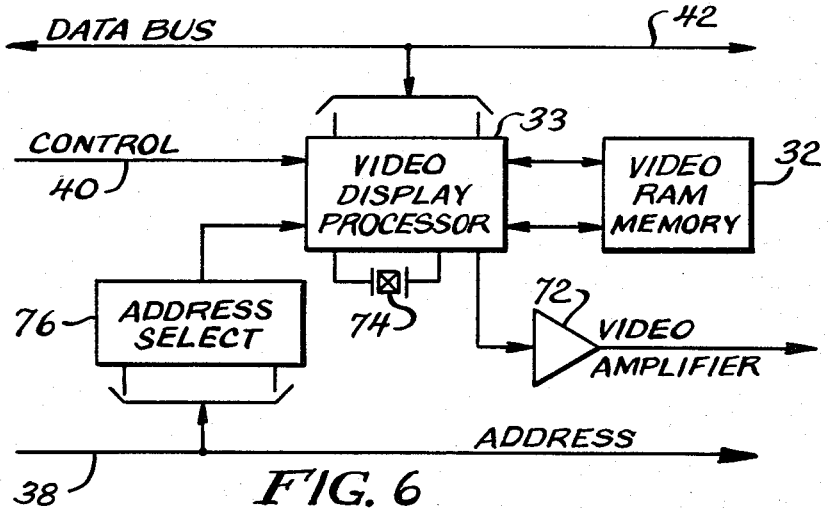
FIG. 6 is a more detailed functional block diagram of the video ram and display processor. Again, the interconnections to the microcomputer are shown to indicate flow of information and control signals.

The video ram 32 and video display processor 33 are depicted in greater detail in FIG. 6 and further comprise the video display processor 33, the video ram memory 32, a video amplifier 72, a quartz timing crystal 74 and address select logic 76.

The video display processor 33 generates all the required video, control and synchronization signals to maintain a 256 by 192 pixel display on a television type monitor. The display processor 33 is available as a single integrated circuit or can be purchased as part of a functional block with video ram included. The video ram memory 32 is used to store the light/dark status of each display pixel where it can then be read by the video processor 33, which then formats and synchronizes the signal and sends it through the video amplifier 72 to the video display 26 of FIG. 3. The video amplifier 72 serves the dual purpose of power amplification and matching the impedence of the display processor 33 to the video display 26 of FIG. 3. The quartz crystal 74 serves as the tuning element for the timing circuits which synchronize the signals to the television type video display.

The image in the video ram memory 32 and thus the video display itself is changed as desired when the microcomputer 22 (FIG. 3) executes a series of write operations to addresses which correspond to the location of each pixel to be displayed. This operation is analogous to the microcomputer writing data to other memory devices using the three internal buses (data, address, and control), with the video ram and display processor being selected by the address select logic.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for electronic measurement of a foot comprising an enclosure, panel means disposed within said enclosure for at times receiving placement thereon of a foot, light source means disposed within said enclosure for projecting light rays upon said panel means, said light rays being effective when a foot is placed upon said panel means to define thereon a shadow outline of said foot, sensing means for viewing said foot shadow outline to receive light energy therefrom and transduce it into an electronic foot image having distinct light-/dark status, and microcomputer means for receiving said electronic foot image, said microcomputer means being effective to resolve said electronic image into a precisely defined, dimensionally accurate measurement of the foot and determine a specific shoe size that fits properly the measured foot.

2. An apparatus as claimed in claim 1 wherein said sensing means includes an array scanner comprising optical means and a light sensitive array.

3. An apparatus as claimed in claim 2 wherein said light sensitive array comprises transparent cover means and integrated circuit means.

4. An apparatus as claimed in claim 1 wherein said light source means comprises flourescent fixture means, reflector means for projecting said light rays collimately upon said panel means, incandescent means for illuminating a heel of the foot placed upon the panel means, and regulating means for providing a preselected degree and intensity of light.

5. Apparatus as claimed in claim 1 wherein said microcomputer means comprises peripheral device means for utilizing said resolved foot measurement for determining said specific shoe size.

6. Apparatus as claimed in claim 1 wherein said panel means is translucent, comprising reflective means for receiving the light rays from the panel means and redirecting said light rays to said sensing means.

7. Apparatus as claimed in claim 6 wherein said reflective means comprises a first reflective mirror and a second reflective mirror.

8. Apparatus as claimed in claim 1 wherein said sensing means comprises optical means for receiving said light rays defining said foot shadow outline, means for focusing said foot shadow outline, and photo-sensitive means for transducing said electronic image into distinct status of black and white light.

9. Apparatus as claimed in claim 1 comprising video display means for displaying to customer view said electronic foot image.

10. Apparatus for electronic measurement of a foot comprising an enclosure, translucent panel means disposed within said enclosure for at times receiving placement thereon of a foot, light source means disposed within said enclosure for projecting collimated light rays upon said panel means, said light rays being effective when a foot is placed upon said panel means to define thereon a shadow outline of said foot, reflective means for receiving and redirecting said light rays, optical means for receiving said redirected light rays defining said foot shadow outline, means for focusing said foot shadow outline, sensing means for viewing said foot shadow outline to receive light energy therefrom and transduce said light energy into an electronic foot image having distinct status of black and white light, microcomputer means for receiving said electronic foot image, said microcomputer means being effective to resolve said electronic foot image into a precisely defined dimensionally accurate measurement of the foot and determine a specific foot size that fits properly the measured foot, and video display means for displaying to customer view said electronic foot image.

11. Apparatus as claimed in claim 10 wherein said microcomputer means comprises peripheral device means for utilizing said resolved foot measurement for determining said specific shoe size.

12. A method for electronic measurement of a foot comprising the steps of placing a foot upon a panel disposed in an enclosure, directing rays of light upon said foot to create thereabout a shadow outline of the foot on said panel, directing said shadow outline from said panel to an array scanner, transducing electrical energy of said shadow outline into an electronic image of said foot, and resolving said electronic foot image into a dimensionally accurate measurement of the foot.

13. A method for electronic measurement of a foot as claimed in claim 12 comprising the step of utilizing said resolved foot measurement for determining a specific shoe size that fits properly the measured foot.

14. A method for electronic measurement of a foot as claimed in claim 13 comprising the step of providing a video display device for customer view showing said resolved electronic foot image and said specific shoe size.

* * * * *